US007572131B2

(12) United States Patent
Alden, III et al.

(10) Patent No.: US 7,572,131 B2
(45) Date of Patent: Aug. 11, 2009

(54) ELECTRICAL INTERCONNECT SYSTEM UTILIZING NON-CONDUCTIVE ELASTOMERIC ELEMENTS

(75) Inventors: Wayne S. Alden, III, Whitman, MA (US); Jeffery W. Mason, North Attleboro, MA (US); Peter Wapenski, Foster, RI (US); Curtis G. Knaub, Douglas, MA (US)

(73) Assignee: Tyco Electronics Corporation, Middletown, PA (US)

( * ) Notice: Subject to any disclaimer, the term of this patent is extended or adjusted under 35 U.S.C. 154(b) by 41 days.

(21) Appl. No.: 11/717,465

(22) Filed: Mar. 13, 2007

(65) Prior Publication Data

US 2008/0227307 A1 Sep. 18, 2008

(51) Int. Cl.
*H01R 4/58* (2006.01)

(52) U.S. Cl. ..... 439/91

(58) Field of Classification Search ..... 439/66, 439/91

See application file for complete search history.

(56) References Cited

U.S. PATENT DOCUMENTS

| | | | | | |
|---|---|---|---|---|---|
| 4,548,451 | A * | 10/1985 | Benarr et al. | ..... | 439/85 |
| 5,230,632 | A * | 7/1993 | Baumberger et al. | ..... | 439/66 |
| 5,632,631 | A * | 5/1997 | Fjelstad et al. | ..... | 439/82 |
| 5,984,691 | A * | 11/1999 | Brodsky et al. | ..... | 439/66 |
| 6,056,557 | A * | 5/2000 | Crotzer et al. | ..... | 439/66 |
| 6,186,797 | B1 * | 2/2001 | Wang et al. | ..... | 439/66 |
| 6,945,788 | B2 | 9/2005 | Trout et al. | | |
| 7,059,869 | B2 * | 6/2006 | Wertz et al. | ..... | 439/71 |
| 7,070,420 | B1 | 7/2006 | Wakefield et al. | | |
| 7,090,507 | B2 * | 8/2006 | Wertz et al. | ..... | 439/68 |
| 7,435,099 | B2 * | 10/2008 | Kirkus | ..... | 439/66 |

* cited by examiner

*Primary Examiner*—Michael C Zarroli
*Assistant Examiner*—Vladimir Imas

(57) ABSTRACT

An electrical interconnect system for providing electrical connection between two or more opposing arrays of contact areas, the electrical interconnect having a conductive substrate and conductors electrically isolated from the substrate.

9 Claims, 11 Drawing Sheets

ELECTRICAL INTERCONNECT SYSTEM UTILIZING NON-CONDUCTIVE ELASTOMERIC ELEMENTS

BACKGROUND

The disclosure relates to an electrical interconnect system, and more particularly to an electrical interconnect system utilizing nonconductive elastomeric elements and conductive elements.

Interconnect devices are used to provide electrical connection between two or more opposing arrays of contact areas for establishing at least one electrical circuit, where the respective arrays may be provided on a device, printed circuit board, Pin Grid Array (PGA), Land Grid Array (LGA), Ball Grid Array (BGA), etc. Interconnection techniques may include soldering, socketing, wire bonding, wire button contacts and plug-in connectors. In one interconnect technique using a Z-axis interconnect device, an array of Z-axis interconnect elements supported on a substrate/carrier provide electrical connection between stacked electrical components. The Z-axis interconnect device is capable of accommodating size constraints, such as related to the reduced physical size of many electrical devices. Additionally, the Z-axis interconnect devices may be non-permanently installed for accommodating the need to remove or replace components of an established electrical circuit(s).

Electrical conductivity may be provided by a Z-axis interconnect device having metal conductive contacts, each contact providing electrical connection between corresponding electrical contacts of the opposing arrays. Establishing reliable contact between the metal contacts and the metal contact areas of either of the opposing arrays may be unreliable due to height variations between electrical contacts of the opposing arrays, variations in thickness of a substrate supporting either of the opposing arrays of the conductive elements of the interconnect device, warping of a substrate of the either of the opposing arrays, etc.

In prior electrical interconnect devices using conductive elastomeric conductive elements, such as disclosed in U.S. Pat. No. 7,070,420, an electrical interconnect device is provided with a non-conductive substrate and an array of electrical contacts held in substantially circular openings in the substrate. Each of the electrical contacts includes a nonconductive elastomeric element and an associated conductive element. The conductive element includes a body having opposite ends that are disposed exteriorly of the respective opposite ends of the nonconductive elastomeric element. The opposite ends of the nonconductive elastomeric element resiliently press against the respective opposite ends of the conductive element when a force is applied to the electrical contact.

SUMMARY

According to one embodiment, the present disclosure provides an electrical interconnect system. The system including a conductive substrate; an array of electrical contacts held in the substrate; and a nonconductive elastomeric element associated with each of the electrical contacts.

In another embodiment of the disclosure, an electrical interconnect system is provided. The system including a conductive substrate having a plurality of voids defined therein including a first subset of the voids and a second subset of the voids. The first subset of the voids includes an anti-rotation feature. The second set of voids is sized and shaped to receive conductive elements therein. The system further including a plurality of nonconductive elements received in the first subset of voids.

In another embodiment of the disclosure, an electrical interconnect system is provided. The system including a conductor element including a conductive layer sized, shaped, and positioned to provide electrical isolation from a substrate when disposed therein; and a nonconductive layer sized and shaped to engage the substrate.

In yet another embodiment of the disclosure, an electrical interconnect system. The system including a substrate having a first set of voids defined therein, each void including a first portion sized and shaped to retain a conductor therein, each void further including a second portion sized and shaped to provide clearance between the substrate and the conductor received therein.

DETAILED DESCRIPTION OF THE DISCLOSURE

Figure 1:
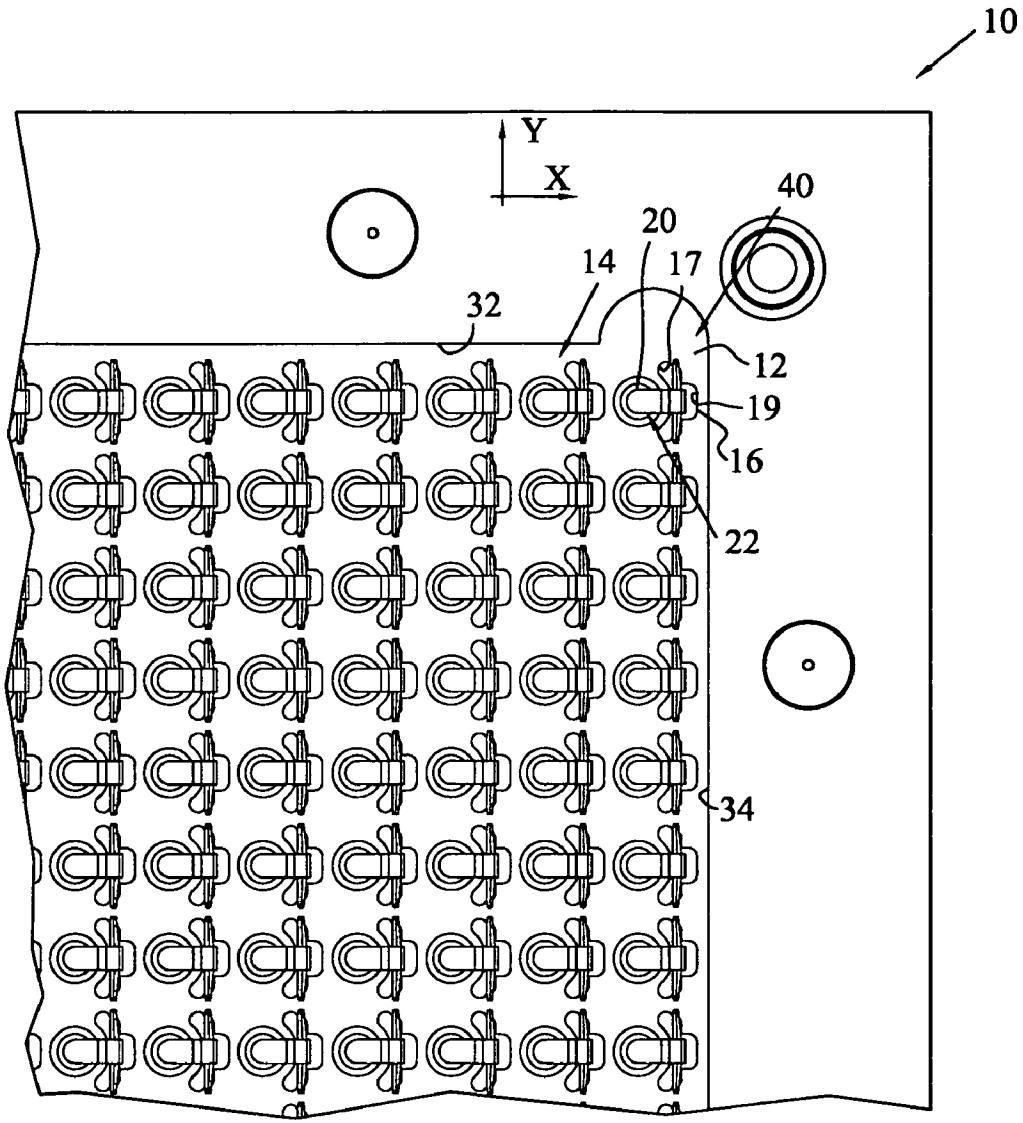
FIG. 1 is a top view of an electrical interconnect system in accordance with the present disclosure.

Electrical interconnect system 10 utilizing a hybrid of nonconductive elements 20 and electrically conductive (e.g., metal) contacts is disclosed. Electrical interconnect system 10 provides an electrical connection between first and second devices, each device including at least one electrical contact, arranged as an array of contacts, where the array of contacts of the first and second devices are provided on first and second opposing boards, respectively, e.g., a printed circuit board or grid. Electrical interconnect system 10 is sandwiched between the first and second opposing boards. Alternatively, interconnect system 10 is sandwiched items such as Pin Grid Arrays (PGA), Land Grid Arrays (LGA), and Ball Grid Arrays (BGA), etc.

For example, the first and second boards may be stacked, and electrical interconnect system 10 may be sandwiched therebetween. The respective electrical contacts of the first board correspond to respective electrical contacts of the second board. Upon assembly of electrical interconnect system 10 with the first and second boards, electrical interconnect system 10 establishes an electrical path, e.g., a path which provides electrical conductivity therethrough, between corresponding electrical contacts of the respective first and second boards, and provides insulation between the established electrical paths.

Reference should be made to the drawings where like reference numerals refer to similar elements throughout the various figures.

Figure 2:
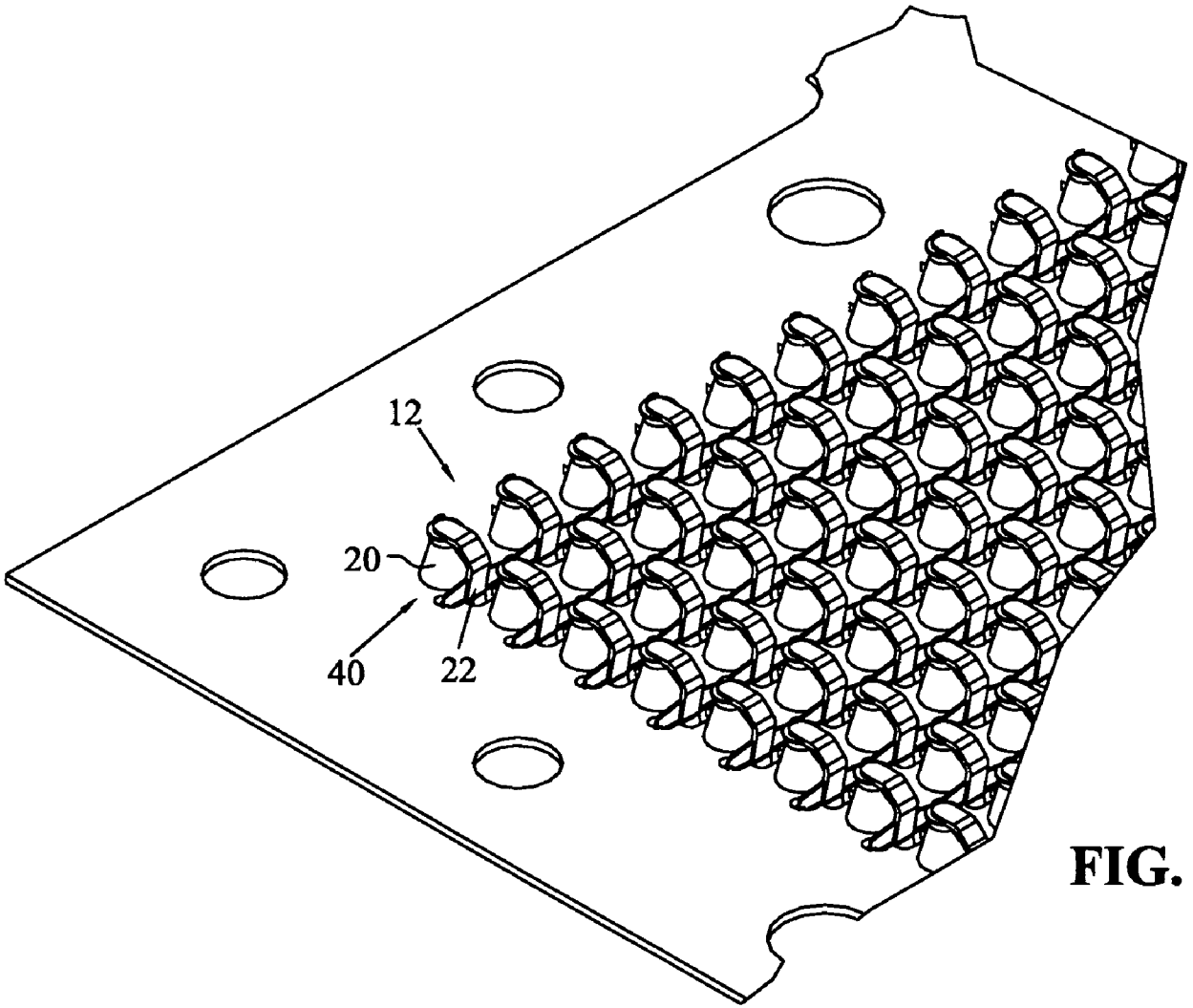
FIG. 2 is a bottom perspective view of the substrate, a nonconductive element and an associated conductor element of the electrical interconnect system shown in FIG. 1.

With reference to FIGS. 1 and 2, electrical interconnect system 10 is shown being generally comprised of a conductive substrate 12 in which an array of openings 14 such as holes or slits, is provided. Electrical interconnect system 10 is provided having a 1 mm pitch. However, it should be appreciated that the features of the present disclosure may be applied to systems having larger and smaller pitches. An array of electrical contacts 40 are provided, which are held within opening 14 of substrate 12. Each of electrical contacts 40 includes nonconductive elastomeric element 20 and associated conductor element 22. With the system generally described, each of the components will now be described.

Figure 9:
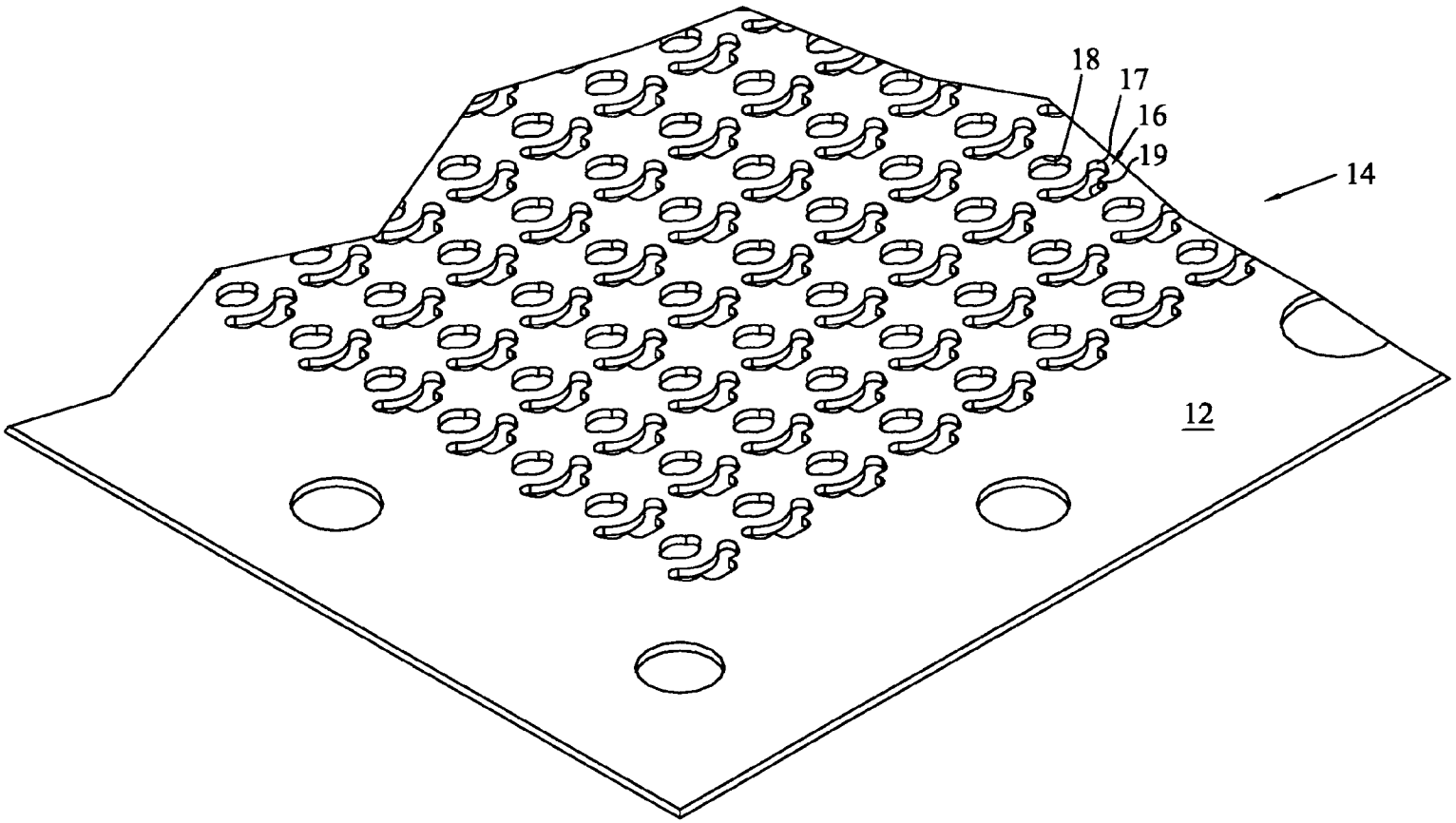
FIG. 9 is a perspective view of the substrate shown in FIG. 2.

With respect now to FIG. 9, substrate 12 will be described in greater detail. Substrate 12 is formed of a conductive material, such as metal. In the provided embodiment, substrate 12 is formed from stainless steel, but other conductive materials are also envisioned. Array of openings 14 includes a plurality of first openings 16 and a plurality of second openings 18, shown in FIG. 9. Each of the first and second openings 16, 18 extends between opposing surfaces of substrate 12. First openings 16 and second openings 18 are sized and shaped to retain conductor elements 22 and nonconductive elements 20, respectively. The widths of first and second openings 16, 18 may be the same, or may be different. It should be appreciated that second openings 18 are not circular. First openings 16 include retaining portions 17 and clearance portions 19.

Figure 10:
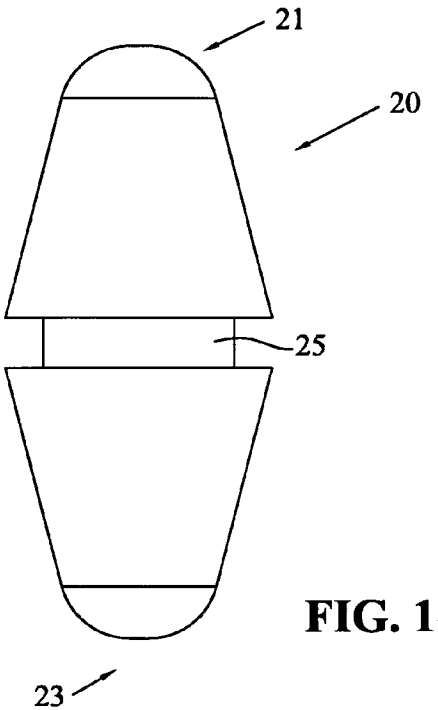
FIG. 10 is a perspective view of the nonconductive element shown in FIG. 2.
Figure 11A:
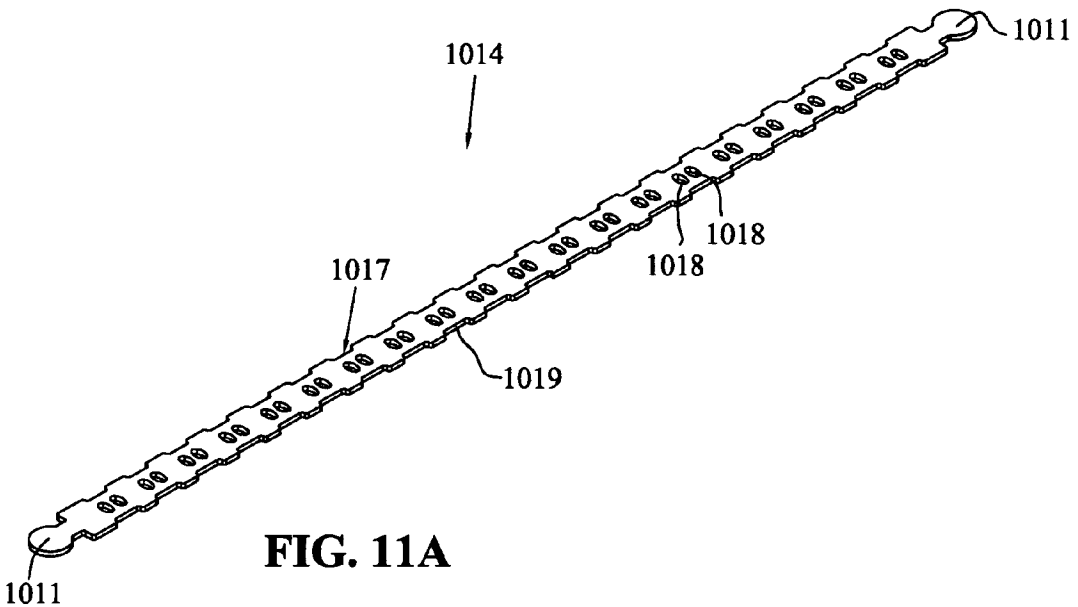
FIGS. 11A and 11B are perspective and top views, respectively, of a substrate part of a second embodiment of the electrical interconnect system.
Figure 11B:
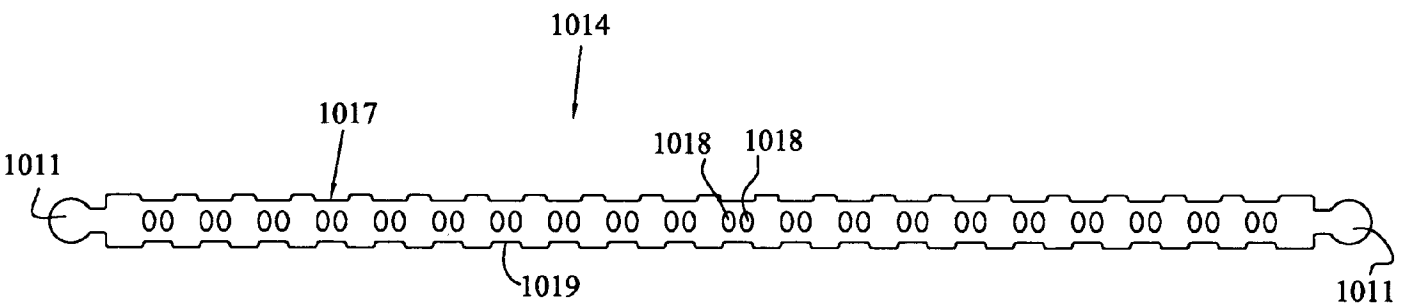

With respect now to FIGS. 10 and 12, nonconductive element 20 will be described in greater detail. Nonconductive element 20 is formed of a nonconductive elastomeric polymer, such as Siloxanes. In the shown embodiment, nonconductive elements 20 are molded onto substrate 12. Nonconductive elements 20 are captively retained to substrate 12, with opposite ends 21, 23 of nonconductive element 20 disposed beyond respective opposite sides of substrate 12. Nonconductive elements 20 may be formed via any process known in the art. In the illustrative embodiment, a portion of nonconductive element 20 extending from substrate 12 is in the form approximating a frustum having a rounded top with the largest width of frustum adjacent substrate 12.

Figure 3:
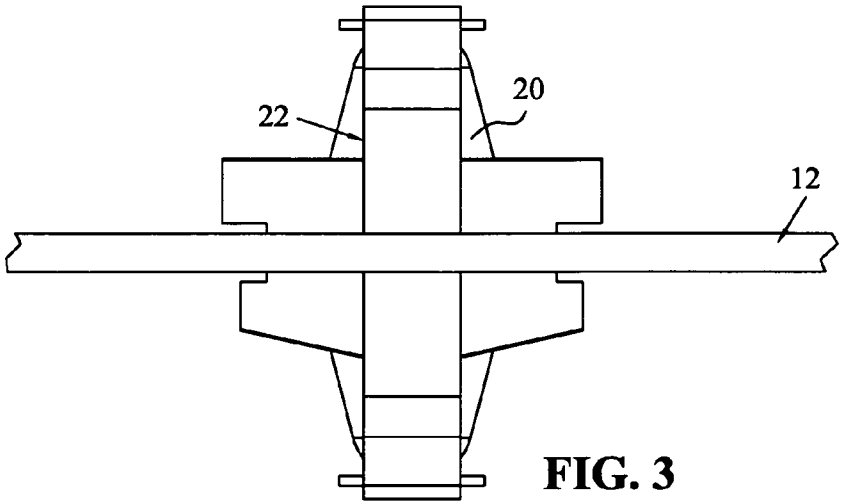
FIG. 3 is a back view of the substrate, nonconductive element and associated conductor element shown in FIG. 2.

As shown in FIGS. 3 and, 4, first and second ends 21 and 23 are provided at opposite ends, respectively, of nonconductive element 20. While the surfaces of first portion 21 and second end 23 of nonconductive element 20 are depicted as being generally hemispherical as shown in FIG. 10, the surfaces of first end 21 and/or second end 23 may be planar, conical or of any other suitable shape for abutting and/or engaging with conductor elements 22, as described further below. The polymer used and the shape of nonconductive element 20 may each be selected for varying and controlling the contact force exerted by electrical interconnect system 10. The durometer characteristics of materials used for nonconductive element 20 may be selected for accommodating application specific conditions.

Retention of respective nonconductive elements 20 within respective openings 18 is facilitated by the largest width of frustum. It should be appreciated, however, that any suitable substantially columnar shape may be employed for nonconductive element 20. Portion 25 of nonconductive elastomeric element 20, shown in FIG. 10, that, when assembled, is coplanar with conductive substrate 12 assumes the shape of second openings 18 via the molding process through which nonconductive elastomeric element 20 is attached. The non-circular shape of second openings 18 provides an anti-rotation feature for nonconductive elastomeric element 20. Other variations as to the shape of second openings 18 and the number of second openings 18 for nonconductive elastomeric element 20 are envisioned to likewise impart an anti-rotation feature. One of these variations is discussed below with respect to second embodiment electrical interconnect system 1010.

Conductor elements 22 will now be described with respect to FIGS. 3-8. Each conductor element 22 includes nonconductive portion 300, flat body 302, and first and second arms 304. Each arm 304 has end portion 306 having an inner surface 308 and an outer surface 310. Outer surface 310 may include an outward extending dimple (not shown), such as a Hertz dot, thereon. As shown, respective end portions 306 are disposed at opposite ends of each conductor element 22. An electrical path is provided between the outer surfaces 310 of respective end portions 306 disposed at the opposite ends of conductor elements 22. When electrical interconnect system 10 is assembled, end portions 306 are disposed exteriorly of respective opposite ends 21, 23 of nonconductive elastomeric element 20 for forming contact 40. Opposite ends 21, 23 of nonconductive elastomeric element 20 resiliently press against respective end portions 306 at the opposite ends of the conductor elements 22 when a force is applied to electrical contact 40.

Figure 4:
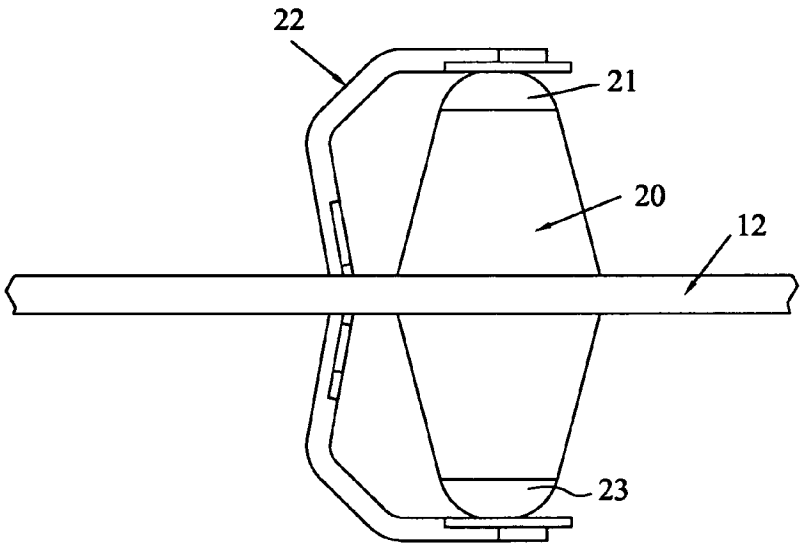
FIG. 4 is a side view of the substrate, nonconductive element and associated conductor element shown in FIG. 2.
Figure 5:
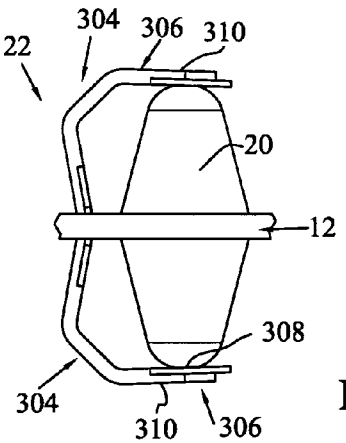
FIG. 5 is a schematic view of the substrate, nonconductive element and associated conductive element shown in FIG. 2, shown with the conductive element formed in a bent position and deflected.
Figure 7:
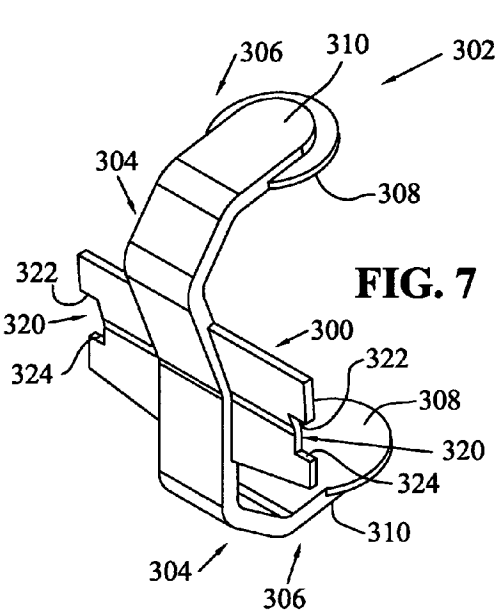
FIG. 7 is a perspective view of the conductor element, shown formed in a bent position, of the electrical interconnect system in accordance with the first embodiment of the disclosure.
Figure 8:
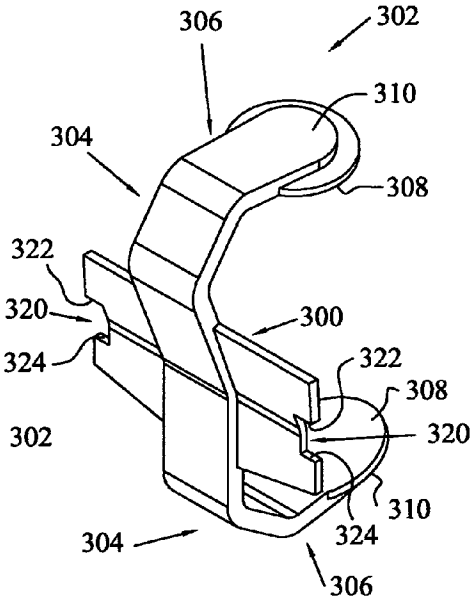
FIG. 8 s a is a perspective view of the conductor element, shown formed in a bent position and deflected, of the electrical interconnect system in accordance with the first embodiment of the disclosure.
Figure 6:
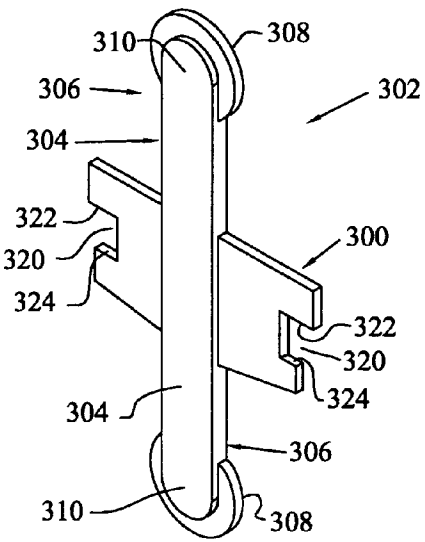
FIG. 6 is a perspective view of the conductor element, shown in an extended position, of the electrical interconnect system in accordance with the first embodiment of the disclosure.

FIGS. 6 and 7 show conductor element 22 once it has been cut and stamped from metal sheet stock. FIGS. 3, 4 and 7 show conductor elements 22 formed in a bent position for abutting and/or engaging nonconductive element 20 or for preparing to abut and/or engage nonconductive element 20. FIGS. 5 and 8 show conductor elements 22 formed in a bent position and deflected, such as due to an axial compressive force, for abutting and/or engaging nonconductive element 20. As shown in FIGS. 3, 4 and 5, outer surface 310 of end portion 306 of arms 304 of conductor elements 22 are exposed as a contact area for making electrical contact with electrical contacts of the opposing boards, and providing an electrical path between an electrical contact of one board of the opposing boards and a corresponding electrical contact of the other opposing board.

Body 302 of conductor elements 22 may be formed entirely of a conductive metal, such as copper, a phosphor bronze alloy, beryllium, gold, nickel, silver, or an alloy of the aforementioned elements or alloy. It is envisioned that other materials may be used to form body 302 of conductor elements 22, as long as the electrical path is provided between outer surface 310 of respective end portions 306 of first and second arms 304, where the electrical path is preferably formed entirely of metal. The shape of outer surface 310 of respective end portions 306 may be generally planar, hemispherical, conical or of any other suitable shape for abutting and/or engaging respective electrical contacts of the opposing boards.

Each conductor element 22 is bendable, such as at one or more joints and/or by being formed of a flexible material. When electrical interconnect system 10 is assembled with first and second boards of respective electrical contact arrays having at least one electrical contact (not shown), respective conductor elements 22 are bent and abut their respective associated nonconductive elements 20 for forming interconnect element 40.

When inserted into a corresponding first opening 16, each body 302 of each conductor element 22 is substantially disposed within first openings 16. Nonconductive portion 300 may include a retaining structure for retaining conductor elements 22 within the first openings 16, where the retaining structure may be a separate structure added to body 302, or may be provided by flat body 302 itself. In the example provided, the retaining structure is provided by nonconductive portion 300 which is added to flat body 302. A width of nonconductive portion 300 exceeds the width of retaining portions 17 of first openings 16 for retaining conductor elements 22 within arc shaped retaining portions 17 of first openings 16.

Notches 320 defined in nonconductive portion 300 each include one surface 322 that abuts a top surface of substrate 12 for stopping conductor elements 22 within the first openings 16 and for determining the insertion depth of conductor elements 22 within first openings 16. Notches 320 also include surface 324 that abuts a bottom surface of substrate 12 similarly to how surface 322 abuts the top surface of substrate 12. First and second arms 304 extend from body 302 and are bendable and/or flexible so that inner surfaces 308 of end portions 306 of respective first and second arms 304 abut first portion 21 and second end 23 of nonconductive element 20, respectively. The shape of inner surface 308 of end portion 306 may be formed to conform to the shape first portion 21 and second end 23 of nonconductive element 20. End portion 306 may further be provided with a structure for abutting or grabbing first end 21 and/or second end 23 of nonconductive element 20 for positioning conductor elements 22 with respect to nonconductive element 20 with which it is associated.

With the components as described above, the assembled device will now be described. In the embodiment shown in FIG. 1, respective electrical contacts 40 are held in first and second openings 16, 18 of array of openings 14. An object, such as conductor element 22, that is tightly fit (e.g., pressed) into opening 16 of the array of openings 14 is retained within opening 16 at least partly due to resiliency of conductor element 22, as will be discussed below.

Each nonconductive element 20 retained in second opening 18 is paired with one conductor element 22 that is retained in one first opening 16 adjacent to second opening 18. FIG. 2 shows the substrate 12 with one nonconductive element 20 and its associated conductor element 22 retained in respective voids/openings 16, 18 of array of openings 14.

During assembly of conductor elements 22 with substrate 12, conductor elements 22 are forcibly inserted into the first openings 16, causing associated conductor element 22 to resiliently deform. Notches 320 receive walls of retaining portions 17 of first openings 16 therein, thereby relieving at least some of the pressure that caused associated conductor element 22 to resiliently deform during insertion. Thereby, notches 320 contribute to retaining conductor elements 22 within first openings 16.

In accordance with the embodiment shown in FIG. 1, openings 16 and 18 are arranged in respective columns parallel to an axis designated "y", and arranged in respective rows parallel to an axis designated "x". Each nonconductive element 20 and its respective conductor element 22 of the electrical contacts 40 are aligned along the x-axis. Other embodiments are envisioned where nonconductive elastomeric element 20 and associated conductor element 22 of electrical contacts 40 are aligned relative to the x-axis at an angle between 0 and 90 degrees.

In the example shown, nonconductive elements 20 are spaced evenly from one another along both the x and y axes, the spacing between nonconductive elements 20 along the x-axis is equal to the spacing between nonconductive elements 20 along the y-axis. The spacing shown is appropriate for providing electrical connection between first and second arrays of electrical contacts of opposing boards, in which the electrical contacts of the arrays of the opposing boards are evenly spaced at equal distances along the x-axis and the y-axis, or edges 32 and 34 of substrate 12. In a different exemplary application (not shown), the spacing between nonconductive elements 20 along the x-axis may differ from the spacing of nonconductive elements 20 along the y-axis.

Once associated conductor element 22 is seated in first openings 16, flat body 302 of associated conductor element 22 is positioned such that it does not touch conductive substrate 12. This is allowed via the contact of nonconductive portion 300 to conductive substrate 12 and via the clearance provided by clearance portions 19. Accordingly, flat body 302 has a width dimension that is less than the width of clearance portions 19 at the point where flat body 302 passes through clearance portions 19. Thus, associated conductor element 22 provides flat body 302 that is electrically isolated from conductive substrate 12.

The operation of the interconnect 10 will now be described. With respect to FIGS. 3 and 4 nonconductive element 20 and associated conductor element 22 forming electrical contact 40 are shown assembled in substrate 12, and prior to compression between the opposing boards. FIG. 5 shows nonconductive element 20 and associated conductor element 22 forming electrical contact 40 with axial compressive forces applied from above and below, such as when compressed between the opposing boards.

The abutting of respective outer surfaces 310 of respective conductor elements 22 with respective electrical contacts of the opposing boards may include surface-to-surface contact depending on the shapes of respective outer surfaces 310 and respective conductor elements 22 of the opposing boards. Minimal axial compressive forces may be sufficient to establish reliable electrical connectivity between conductor elements 22 of electrical interconnect system 10 and the contacts of the opposing boards, and for establishing electrical connectivity between the corresponding electrical contacts of the opposing boards. Furthermore, establishment of the electrical connectivity is not susceptible to excessive axial compressive forces.

With reference now to FIGS. 11-16, electrical interconnect system 1010 is shown having conductive substrate 1012 in which an array of openings 1017, 1018, 1019 such as holes or slits, is provided. Electrical interconnect system 1010 is provided having a 0.5 mm pitch. However, it should be appreciated that the features of the present disclosure may be applied to systems having larger and smaller pitches.

Substrate 1012 is composed of a plurality of modular substrate rows 1014 and row receiver 1015. Each row 1014 includes a plurality of first openings 1017, a plurality of pairs of second openings 1018, and a plurality of third openings 1019, shown in FIGS. 11A&B. Each of first, second, and third openings 1017, 1018, 1019 extends between opposing surfaces of rows 1014 of substrate 1012. Rows 1014 further include connection tabs 1011 on the ends thereof that mate with connection voids 1013 defined in edges 1034 of row receiver 1015.

Placing rows 1014 within receiver 1015 results in adjacent rows 1014 abutting or being very close to one another. First openings 1017 of one row 1014 align with third openings 1019 of adjacent rows or openings 1033 defined in edges 1032 of receiver 1015 that are similarly sized to third openings 1019. First and third openings 1017, 1019 are of slightly different sizes, as such first and third openings 1017, 1019 combine to define an opening having a retaining portion and a clearance portion similar to retaining portions 17 and clearance portions 19 of first openings 16. Accordingly, when placed within row receiver 1015, first and third openings 1017, 1019 combine to define conductor openings 1016.

Arrays of electrical contacts 1040 are provided for and held in rows 1014 of substrate 1012. Respective electrical contacts 1040 are held in conductor and second openings 1016, 1018 of rows 1014. Each electrical contact 1040 includes nonconductive elastomeric element 1020 and associated conductor element 1022.

Figure 13:
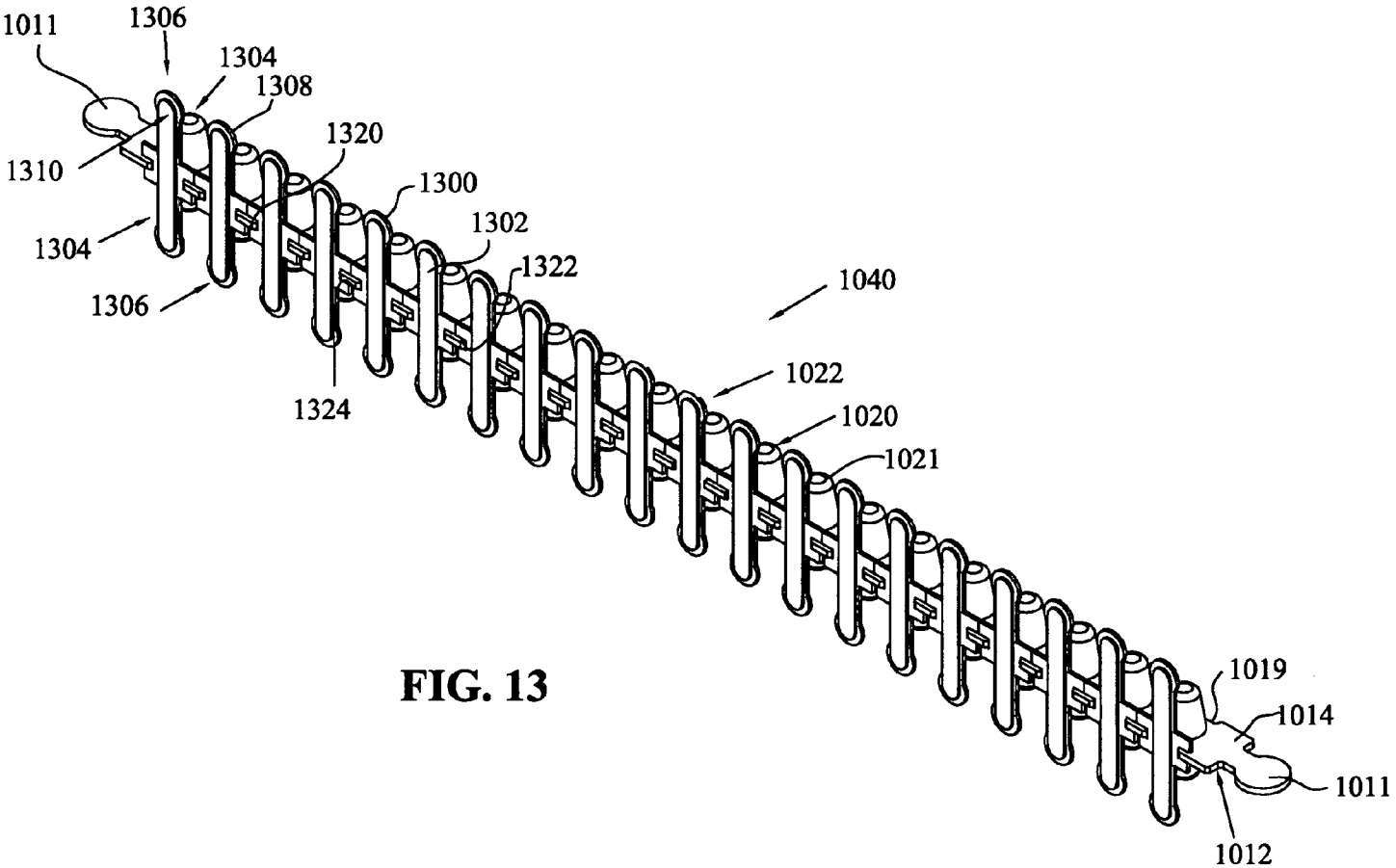
FIG. 13 is a perspective view of the substrate part of FIG. 11, the nonconductive element of FIG. 12, and a conductor element of the second embodiment of the electrical interconnect system.
Figure 14:
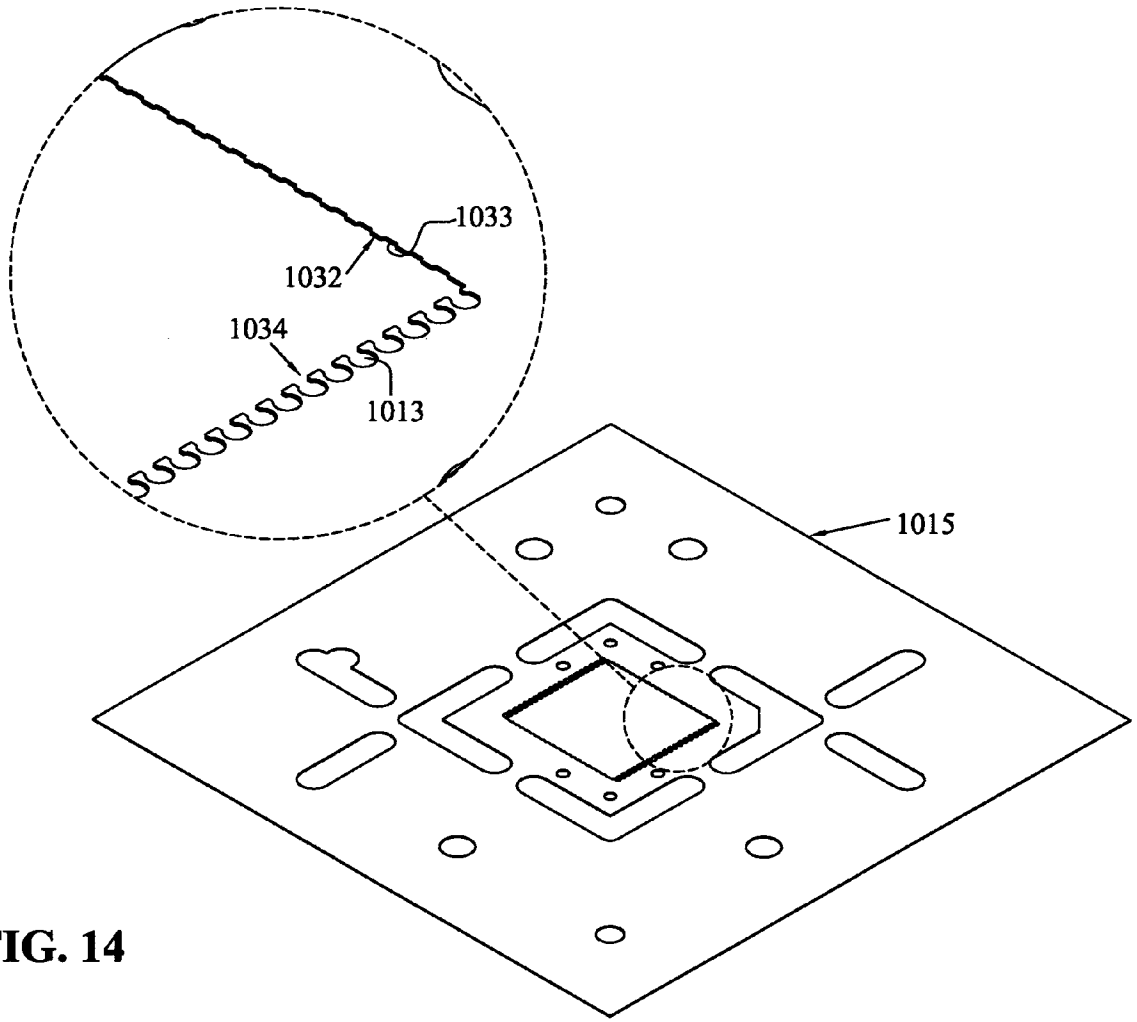
FIG. 14 is a perspective view of a substrate part that receives the substrate part of FIG. 11 for the second embodiment of the electrical interconnect system.
Figure 15:
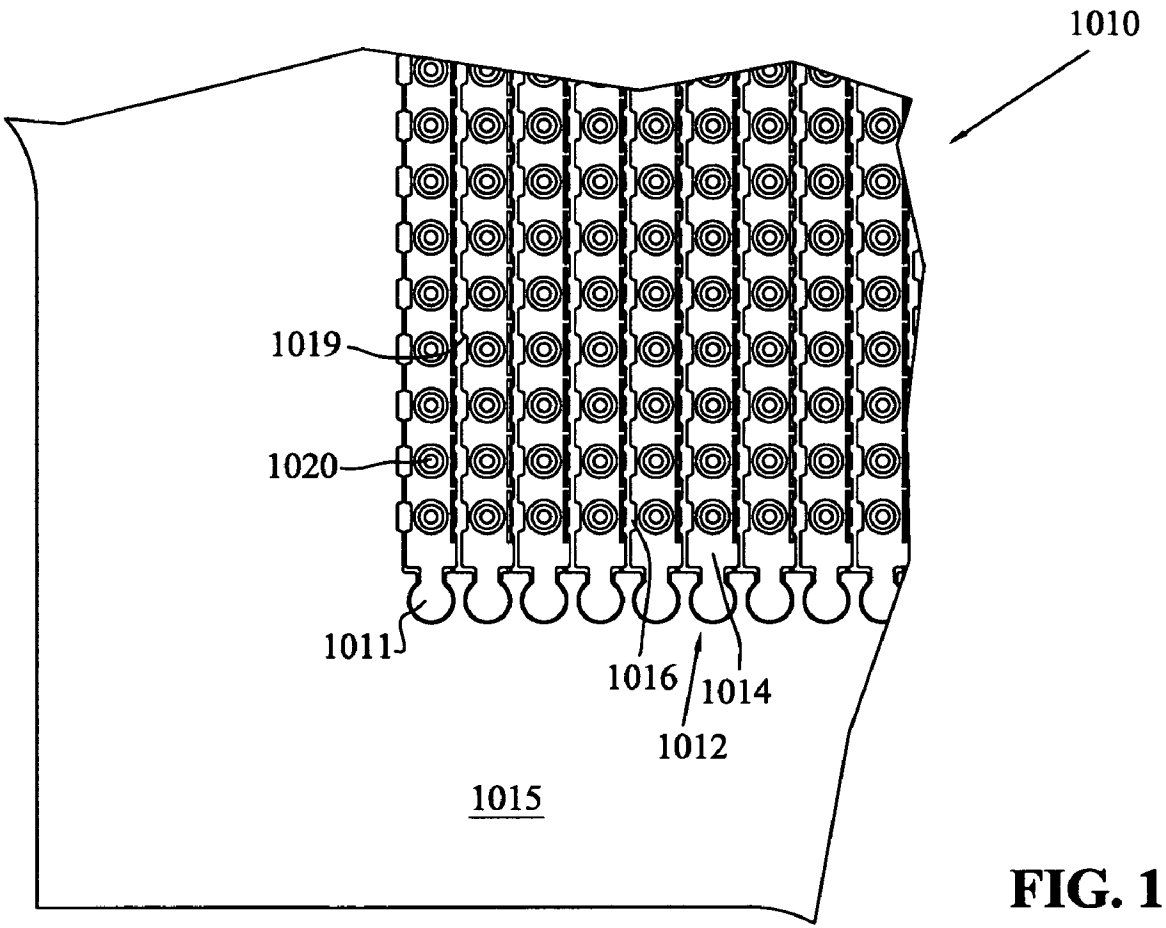
FIG. 15 is a top view of the second embodiment assembled electrical interconnect system combining the substrate part of FIG. 14 and the parts of FIG. 13.
Figure 16:
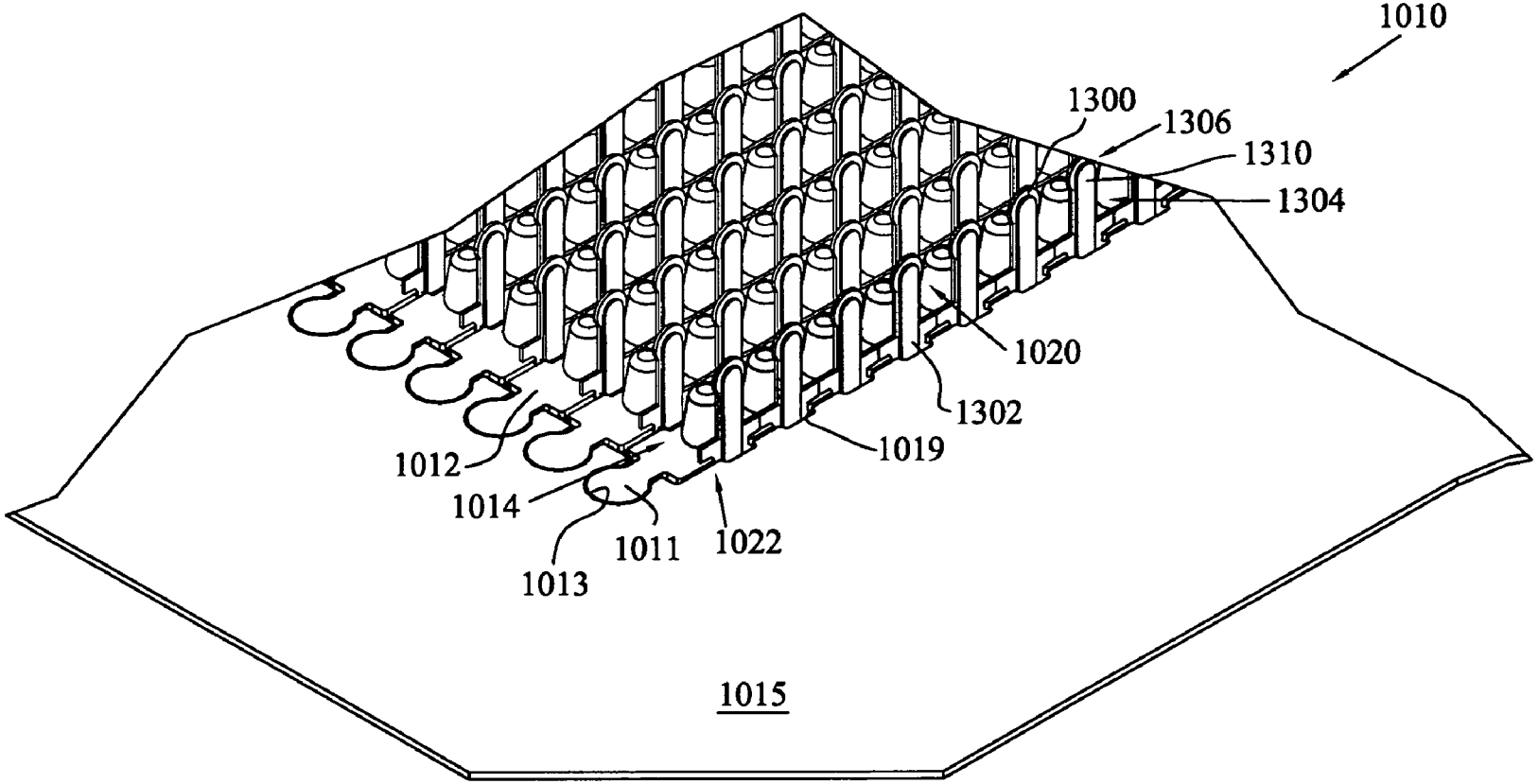
FIGS. 16 is a perspective view of the assembled second embodiment electrical interconnect system of FIG. 15.

FIGS. 13, 15, and 16 show a plurality of nonconductive elements 1020 and conductor elements 1022 retained in rows 1014, with each conductor element 1022 positioned adjacent to its associated nonconductive element 1020. FIG. 13 shows one row 1014 of substrate 1012 with nonconductive elements 1020 and their associated conductor elements 1022 retained in respective openings 1018, 1016 (FIGS. 11A and 11B) of substrate 1012. Whereas conductor elements 1022 are shown assembled and substantially planar in FIGS. 13, 15, and 16, it should be appreciated that, in use, associated conductor elements 1022 assume bent positions similar to the position of conductor element 22 shown in FIG. 5.

Each conductor element 1022 includes nonconductive layer 1300 and conductive trace or layer 1302 disposed thereon. Conductive layer 1302 is disposed externally relative to nonconductive layer 1300 such that, when assembled, nonconductive layer 1300 is between conductive layer 1302 and either row 14 to which it is attached or nonconductive element 1020. Conductor element 1022 is bendable, such as at one or more joints and/or by being formed of a flexible material. When electrical interconnect system 1010 is assembled with first and second boards of respective electrical contact arrays having at least one electrical contact (not shown) respective conductor elements 1022 are bent such that nonconductive layers 1300 abut their respective associated nonconductive elements 1020 for forming interconnect element 1040.

Rows 1014 are formed of a conductive material, such as metal. An object, such as conductor element 1022, that is tightly fit (e.g., pressed) into opening 1016 of row 1014 is retained within opening 1016 at least partly due to resiliency of conductor element 1022, as will be discussed below. Openings 1016 and second openings 1018 are sized and shaped to retain conductor elements 1022 and nonconductive elements 1020, respectively. Openings 1016, as previously discussed, include retaining first portions provided by first openings 1017 and clearance third portions provided by third openings 1019.

As in FIG. 13, respective nonconductive elements 1020 are each held, e.g., retained, by a pair of second openings 1018, and respective conductor elements 1022 are each held, e.g., retained, in openings 1016. Each nonconductive element 1020 retained in a pair of second openings 1018 is paired with one conductor element 1022 that is retained in one opening 1016 adjacent to pair of second openings 18.

In the example shown, nonconductive elements 1020 are spaced evenly from one another along both the x and y axes (along rows 1014 and perpendicular to rows 1014). The spacing shown is appropriate for providing electrical connection between first and second arrays of electrical contacts of opposing boards, in which the electrical contacts of the arrays of the opposing boards are evenly spaced at equal distances along the x-axis and the y-axis, or edges 1032 and 1034 of substrate 1012. In a different exemplary application (not shown), the spacing between nonconductive elements 1020 along the x-axis may differ from the spacing of nonconductive elements 1020 along the y-axis.

With respect to FIGS. 15 and 16 nonconductive element 1020 and conductor element 1022 forming electrical contact 1040 are shown assembled in substrate 1012, and prior to compression between the opposing boards.

Nonconductive element 1020 is formed similarly to nonconductive element 20. In the shown embodiment, nonconductive elements 1020 are molded onto substrate 1012. Nonconductive elements 1020 are captively retained to rows 1014 of substrate 1012. Nonconductive elements 1020 may be formed via any process known in the art. In the illustrative embodiment, a portion of nonconductive element 1020 extending from substrate 1012 is in the form approximating a frustum having a rounded top with the largest width of frustum adjacent substrate 1012. Retention of respective nonconductive elements 1020 within respective openings 1018 is facilitated by the largest width of the frustum and by each element 1020 utilizing a pair of openings 1018. It should be appreciated, however, that any suitable substantially columnar shape may be employed for nonconductive element 1020. Portion 1025 of nonconductive elastomeric element 1020, shown in FIG. 12, that, when assembled, is coplanar with conductive substrate 1012 assumes the shape of pair of second openings 1018 via the molding process through which nonconductive elastomeric element 1020 is attached. It should be appreciated that each elastomeric element 1020 engages two of second openings 1018. Engaging two of second openings 1018 provides an anti-rotation feature for nonconductive elastomeric element 1020. Other variations of second openings 1018 for nonconductive elastomeric element 1020 are envisioned to likewise impart an anti-rotation feature.

Figure 12:
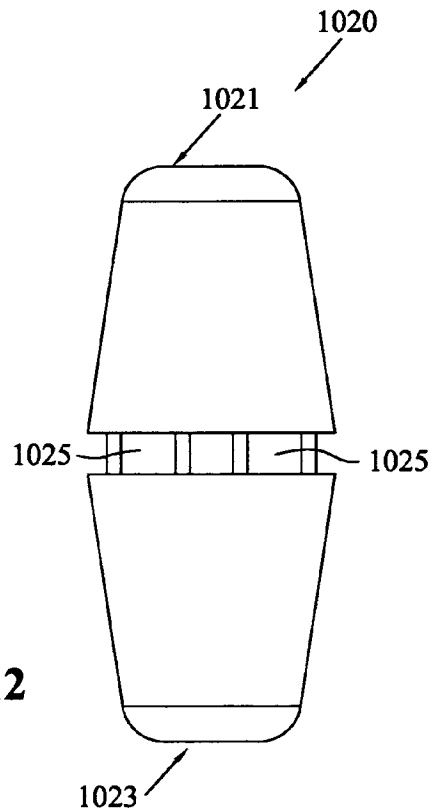
FIG. 12 is a side view of a nonconductive element used with the substrate part shown in FIG. 11 of the second embodiment of the electrical interconnect system.

As shown in FIGS. 12 and 13, first portion 1021 and second portion 1023 are provided at opposite ends, respectively, of nonconductive element 1020. While the surfaces of first portion 1021 and second portion 1023 of nonconductive element 1020 are depicted as being generally hemispherical as shown in FIG. 12, the surfaces of first portion 1021 and/or second portion 1023 may be planar, conical or of any other suitable shape for abutting and/or engaging with conductor elements 1022, as described further below. The polymer used and the shape of nonconductive element 1020 may each be selected for varying and controlling the contact force exerted by electrical interconnect system 1010. The durometer characteristics of materials used for nonconductive element 1020 may be selected for accommodating application specific conditions.

Each conductor element 1022 includes nonconductive layer 1300, conductive layer 1302. Each conductor element 1022 further includes first and second arms 1304. Each arm 1304 has end portion 1306 having an inner surface 1308 of nonconductive layer 1300 and an outer surface 1310 of conductive layer 1302. As shown, respective end portions 1306 are disposed at opposite ends of each conductor element 1022. An electrical path is provided between the outer surfaces 1310 of respective end portions 1306 disposed at the opposite ends of conductor elements 1022. When electrical interconnect system 1010 is assembled, end portions 1306 are disposed exteriorly of respective opposite ends 1021, 1023 of nonconductive elastomeric element 1020 for forming contact 1040. Opposite ends 1021, 1023 of nonconductive elastomeric element 1020 resiliently press against respective end portions 1306 at the opposite ends of the conductor elements 1022 when a force is applied to electrical contact 1040.

When inserted into a corresponding openings 1016, each conductive layer 1302 of each conductor element 1022 is substantially disposed within first openings 1016. Nonconductive layer 1300 includes a retaining structure for retaining conductor elements 1022 within the openings 1016. A width of nonconductive portion 1300 exceeds the width of first openings 1017 of openings 1016 for retaining conductor elements 1022 within first openings 1017 of first openings 1016. During assembly of conductor elements 1022 with rows 1014 of substrate 1012, conductor elements 1022 are coupled to openings 1016. Notches 1320 receive walls of first openings 1017 of openings 1016 therein, frictionally engaging upper and lower walls of first openings 1017. Thereby, notches 1320 contribute to retaining conductor elements 1022 within openings 1016.

Notches 1320 defined in nonconductive layer 1300 each include one surface 1322 that abuts a top surface of substrate 1012. Notches 1320 also include surface 1324 that abuts a bottom surface of substrate 1012 similarly to how surface 1322 abuts the top surface of substrate 1012. First and second arms 1304 are bendable and/or flexible so that inner surfaces 1308 of end portions 1306 of respective first and second arms 1304 abut first portion 1021 and second portion 1023 of nonconductive element 1020, respectively. The shape of inner surface 1308 of end portion 1306 may be formed to conform to the shape first portion 1021 and second portion 1023 of nonconductive element 1020. End portion 1306 may further be provided with a structure for abutting or grabbing first portion 1021 and/or second portion 1023 of nonconductive element 1020 for positioning conductor elements 1022 with respect to nonconductive element 1020 with which it is associated.

As shown in FIG. 16, outer surface 1310 of end portion 1306 of arms 1304 of conductor elements 1022 are exposed as a contact area for making electrical contact with electrical contacts of the opposing boards, and providing an electrical path between an electrical contact of one board of the opposing boards and a corresponding electrical contact of the other opposing board.

Conductive layer 1302 of conductor elements 1022 may be formed entirely of a conductive metal, such as copper, a phosphor bronze alloy, beryllium, gold, nickel, silver, or an alloy of the aforementioned elements or alloy. It is envisioned that other materials may be used to form conductive layer 1302 of conductor elements 1022, as long as the electrical path is provided between outer surface 1310 of respective end portions 1306 of first and second arms 1304, where the electrical path is preferably formed entirely of metal. The shape of outer surface 1310 of respective end portions 1306 may be generally planar, hemispherical, conical or of any other suitable shape for abutting and/or engaging respective electrical contacts of the opposing boards. The abutting of respective outer surfaces 1310 of respective conductor elements 1022 with respective electrical contacts of the opposing boards may include surface-to-surface contact depending on the shapes of respective outer surfaces 1310 and respective conductor elements 1022 of the opposing boards. Minimal axial compressive forces may be sufficient to establish reliable electrical connectivity between conductor elements 1022 of electrical interconnect system 1010 and the contacts of the opposing boards, and for establishing electrical connectivity between the corresponding electrical contacts of the opposing boards. Furthermore, establishment of the electrical connectivity is not susceptible to excessive axial compressive forces.

As previously discussed, once conductor element 1022 is seated in conductor openings 1016, conductive layer 1302 of conductor element 1022 is positioned such that it does not touch conductive substrate 1012. This is allowed via the contact of nonconductive layer 1300 to conductive substrate 1012 and via the clearance provided by third openings 1019, or by similar features defined in edge 1034 of row receiver 1015. Accordingly, conductive layer 1302 has a width dimension that is less than the width of third openings 1019 at the point where conductive layer 1302 passes through third openings 1019. Thus, conductor element 1022 provides conductive layer 1302 that is electrically isolated from conductive conductive substrate 1012.

While this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An electrical interconnect system including:

a conductive substrate having a plurality of voids defined therein including a first subset of the voids and a second subset of the voids, the first subset of the voids including an anti-rotation feature, the second subset of voids being sized and shaped to receive conductive elements therein; and a plurality of nonconductive elements received in the first subset of voids.

2. The system of claim 1, wherein the anti-rotation feature includes a section of each of the voids of the first subset of voids having a non-constant diameter.

3. The system of claim 1, wherein the anti-rotation feature includes a plurality of holes receiving each nonconductive element.

4. The system of claim 1, wherein the nonconductive elements are formed on the substrate and include a portion that takes on dimensions of at least one void of the first subset of voids.

5. The system of claim 1, further including a conductor having a nonconductive layer and a conductive layer, the conductor contacting the nonconductive element such that the nonconductive layer is between the conductive layer and the nonconductive element.

6. An electrical interconnect system including:

a substrate having a first set of voids and a second set of voids defined therein, each void of the first set including a first portion retaining a conductor therein, and a second portion sized and shaped to provide clearance between the substrate and the conductor retained in the first portion, each void of the second set retaining a nonconductive element therein.

7. The system of claim 6, wherein the second portion of each void is aligned with a conductive layer of the conductor retained in the first portion.

8. The system of claim 6, wherein each first portion approximates an arc.

9. The system of claim 6, wherein the substrate includes a plurality of modular rows and the first and second portions are respectively defined in adjacent modular rows.

* * * * *